US010918158B2

(12) United States Patent
Linkfield et al.

(10) Patent No.: US 10,918,158 B2
(45) Date of Patent: Feb. 16, 2021

(54) ARTICLE OF FOOTWEAR WITH ENLARGED THROAT OPENING AND SELECTIVE VENTILATION

(71) Applicant: NIKE, Inc., Beaverton, OR (US)

(72) Inventors: Brian Linkfield, Lake Oswego, OR (US); Darryl Matthews, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 84 days.

(21) Appl. No.: 16/419,679

(22) Filed: May 22, 2019

(65) Prior Publication Data

US 2019/0365022 A1 Dec. 5, 2019

Related U.S. Application Data

(60) Provisional application No. 62/678,776, filed on May 31, 2018.

(51) Int. Cl.

| | |
|---|---|
| ***A43B 7/08*** | (2006.01) |
| ***A43B 3/00*** | (2006.01) |
| ***A43B 3/24*** | (2006.01) |
| ***A43B 7/12*** | (2006.01) |
| ***A43B 11/00*** | (2006.01) |
| ***A43B 23/02*** | (2006.01) |
| *A43B 13/14* | (2006.01) |

(52) U.S. Cl.

CPC ..... *A43B 7/08* (2013.01); *A43B 3/0036* (2013.01); *A43B 3/24* (2013.01); *A43B 7/085* (2013.01); *A43B 7/12* (2013.01); *A43B 11/00* (2013.01); *A43B 23/02* (2013.01); *A43B 13/14* (2013.01)

(58) Field of Classification Search

CPC .... A43B 3/24; A43B 3/16; A43B 7/06; A43B 7/08; A43B 7/12; A43B 23/02

USPC ..... 36/45, 50.1, 3 A

See application file for complete search history.

(56) References Cited

U.S. PATENT DOCUMENTS

| | | | | |
|---|---|---|---|---|
| 131,862 | A | 10/1872 | Evans | |
| 189,333 | A * | 4/1877 | Bibbins ..... | A43C 1/00 36/50.1 |

(Continued)

FOREIGN PATENT DOCUMENTS

| | | | |
|---|---|---|---|
| DE | 10209099 | C1 | 1/2003 |
| EP | 2883467 | A1 | 6/2015 |
| KR | 20140004204 | U | 7/2014 |

*Primary Examiner* — Marie D Bays

(74) *Attorney, Agent, or Firm* — Quinn IP Law

(57) ABSTRACT

An article of footwear includes a sole structure and an upper that is coupled to the sole structure to at least partially defining an internal volume that is operative to receive a foot of the wearer. The upper includes an enlarged throat opening that is in communication with the internal volume and a forwardly extending flap section that defines a portion of the enlarged throat opening. The flap section is operative to fold laterally across an instep portion of the upper to reduce the size of the throat opening. Additionally, a plurality of perforations extend through a portion of the upper on a first side of the flap section. Folding the flap section laterally in a first direction covers the plurality of perforations to provide selective water resistance. Conversely, folding the flap section laterally in a second direction exposes the plurality of perforations to provide ventilation to the interior volume.

20 Claims, 2 Drawing Sheets

(56) References Cited

U.S. PATENT DOCUMENTS

| | | | | | |
|---|---|---|---|---|---|
| 229,290 | A * | 6/1880 | Weaver | A43C 1/00 | 36/50.1 |
| 330,592 | A * | 11/1885 | Lavey | A43B 3/16 | 36/7.3 |
| 342,806 | A * | 6/1886 | Moor | A43C 1/00 | 36/50.1 |
| D17,705 | S | 9/1887 | Elderkin | | |
| 1,294,179 | A * | 2/1919 | Schneider | A43C 1/00 | 36/50.1 |
| 1,457,402 | A * | 6/1923 | Smith | A43C 11/02 | 36/50.1 |
| 1,542,502 | A * | 6/1925 | Guerrant | A43B 23/045 | 36/50.1 |
| D150,694 | S | 8/1948 | Hardman | | |
| 2,517,189 | A * | 8/1950 | Fitterling | A43B 3/16 | 36/7.3 |
| 2,652,637 | A | 9/1953 | Hardman | | |
| D172,742 | S | 8/1954 | Doherty | | |
| D173,138 | S | 10/1954 | Bingham | | |
| 2,725,647 | A | 12/1955 | Hugger | | |
| 2,933,831 | A | 4/1960 | Compte | | |
| D274,672 | S | 7/1984 | Garrett | | |
| 4,512,089 | A | 4/1985 | Carrier | | |
| 4,908,960 | A | 3/1990 | Hoyt, Jr. | | |
| D346,059 | S | 4/1994 | Schnee | | |
| 5,813,149 | A * | 9/1998 | Baker | A43B 11/00 | 36/105 |
| 7,017,287 | B2 | 3/2006 | Allen | | |
| D565,284 | S | 4/2008 | Miller | | |
| D644,829 | S | 9/2011 | Spring | | |
| 9,044,063 | B2 | 6/2015 | Loverin et al. | | |
| D764,152 | S | 8/2016 | Zasloff | | |
| 2007/0277398 | A1* | 12/2007 | Davis | A43B 1/0081 | 36/50.1 |
| 2009/0019736 | A1 | 1/2009 | Ng et al. | | |
| 2010/0299968 | A1* | 12/2010 | Matsueda | A43C 15/02 | 36/134 |
| 2014/0157624 | A1 | 6/2014 | Girard et al. | | |
| 2016/0331084 | A1 | 11/2016 | Xanthos et al. | | |

* cited by examiner

ARTICLE OF FOOTWEAR WITH ENLARGED THROAT OPENING AND SELECTIVE VENTILATION

CROSS REFERENCE TO RELATED APPLICATIONS

The present application claims the benefit of priority from U.S. Provisional Patent Application No. 62/678,776, filed on 31 May 2018, which is incorporated by reference in its entirety.

TECHNICAL FIELD

The present disclosure relates generally to an article of footwear with improved accessibility and selective ventilation or water resistance.

BACKGROUND

Articles of footwear generally include two primary elements: an upper and a sole. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. In many designs, the upper may also incorporate a lacing system to adjust the fit of the footwear, as well as permitting entry and removal of the foot from the void within the upper.

The sole may be constructed to provide stability and cushioning. The sole may include an outsole, a midsole and an insole. The midsole provides support and cushioning while the outsole provides improved traction with the ground. The insole may provide increased comfort for the foot.

DETAILED DESCRIPTION

Figure 1:
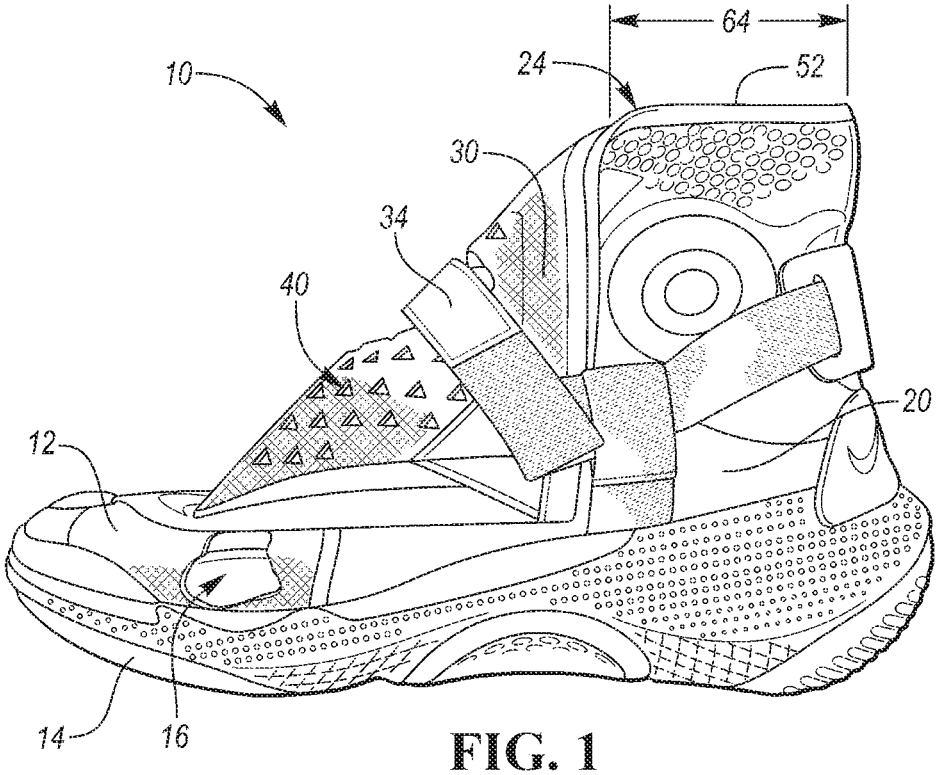
FIG. 1 is a schematic side perspective view of an article of footwear with a forward flap section secured in a ventilated configuration.

The present embodiments discussed below are directed to an article of footwear, and more specifically an upper for an article of footwear that provides improved access to a wearer's foot while also providing an ability to convert between a ventilated configuration and a water resistant configuration. In particular, this design includes an enlarged throat opening that is at least partially defined by a forwardly extending flap section. The enlarged throat opening in communication with the internal volume to provide an expanded corridor through which a wearer may extend their foot when putting on or taking off the shoe. The flap section is operative to fold laterally across an instep portion of the upper to then reduce the size of the throat opening to a more traditional size once the wearer's foot is positioned within the internal volume. The upper further includes a plurality of perforations that extend through a sidewall of the upper on a first side of the flap section. Folding the flap section laterally in a first direction covers the plurality of perforations to provide selective water resistance. Conversely, folding the flap section laterally in a second direction exposes the plurality of perforations to provide ventilation to the interior volume.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure.

Also, it is to be understood that the phraseology and terminology used herein is for the purpose of description and should not be regarded as limiting.

Referring to the drawings, wherein like reference numerals are used to identify like or identical components in the various views, FIGS. 1-4 schematically illustrate an article of footwear 10 that includes an upper 12 coupled with a sole structure 14. In the current embodiment, the article of footwear 10 is shown in the form of a high-top athletic shoe, such as a basketball shoe. In other embodiments, however, an article incorporating the features described below could take the form of other kinds of footwear including, but not limited to, hiking boots, soccer shoes, football shoes, sneakers, running shoes, cross-training shoes, rugby shoes, basketball shoes, baseball shoes, and other kinds of shoes. Moreover, in some embodiments the disclosed provisions may be configured for use with various kinds of non-sports-related footwear, including, but not limited to, slippers, sandals, loafers, or other such designs/configurations.

As commonly understood, the upper 12 is a portion of the article of footwear 10 that alone, or together with the sole structure, defines an interior cavity (shown in the schematic partial cutaway at 16 in FIG. 1) that is adapted to receive a foot of a wearer. The upper 12 includes an enlarged throat opening that may provide a wearer's foot with improved access to the interior cavity 16. For the purpose of consistency and clarity, the "interior" of a shoe refers to space that is occupied by a wearer's foot when the shoe is worn, the "front" refers to portions of the shoe that are closest to the toe-end, and the "rear" refers to portions of the shoe that are closes to the heel-end.

The sole structure 14 may be permanently attached to one or more portions of upper 12 (for example, with adhesive, stitching, welding, or other suitable techniques) and may generally extend between the upper 12 and the ground (i.e., when worn in a typical manner). For purposes of this disclosure, the term "permanently attached" shall refer to two components joined in a manner such that the components may not be readily separated (for example, without destroying one or both of the components). In addition, two components may be "permanently attached" by virtue of being integrally formed, for example, through a molding process.

The sole structure 14 may include provisions for attenuating ground reaction forces (i.e., cushioning and stabilizing the foot during vertical and horizontal loading). In addition, sole structure 14 may be configured to provide traction, impart stability, and control or limit various foot motions, such as pronation, supination, or other motions. For example, the disclosed concepts may be applicable to footwear configured for use on any of a variety of surfaces, including indoor surfaces or outdoor surfaces. In some embodiments, the sole structure 14 may be configured to provide traction and stability on hard indoor surfaces (such as hardwood), soft, natural turf surfaces, or on hard, artificial turf surfaces.

In different embodiments, the sole structure 14 may include different components that may individually or collectively provide the article with a number of attributes, such as support, rigidity, flexibility, stability, cushioning, comfort, reduced weight, or other attributes. For example, the sole structure 14 may include one or more of an outsole, a midsole, a cushioning layer, and/or an insole. It may be appreciated however that the sole structure 14 is not limited to incorporating traditional sole components and may incorporate various different kinds of elements arranged at the outermost, inner most and intermediate 'layers', or locations, of the sole. Thus, the sole structure 14 can include an outer sole member or element, which may or may not coincide with a conventional 'outsole'. Likewise, the sole structure 14 may include an inner sole member or element, which may or may not be an 'insole'. Further, the sole structure 14 can include any number of intermediate and/or middle sole members or elements, which may or may not be a 'midsole'.

With continued reference to FIGS. 1-4, the upper 12 may generally include a first side portion 20 or first quarter, a second side portion 22 or second quarter, and a throat opening 24 that at least partially separates the first side portion 20 from the second side portion 22. When worn, the first side portion 20 and second side portion 22 may at least partially extend on opposite medial and lateral sides of the wearer's foot, and the wearer's ankle may extend through the throat opening 24.

Figure 2:
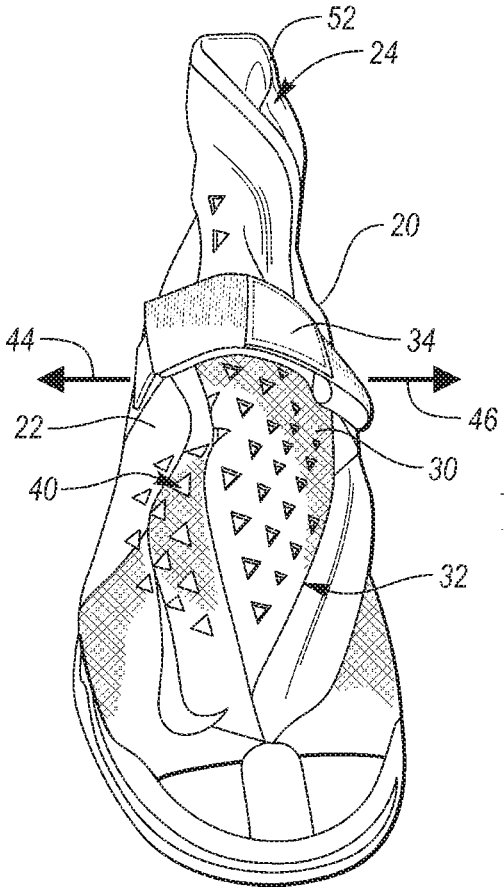
FIG. 2 is a schematic top perspective view of the article of footwear of FIG. 1.

As generally illustrated in FIGS. 1-2, the first and second side portions 20, 22 may cooperate to define flap section 30 that partially serves as a closure for the upper 12. The flap section 30 may fold laterally across an instep portion 32 of the upper 12, and then may be secured in place through a temporary affixment means such as a clasp, strap, hook and loop fastener, snap, elastic band, lace and hook, or other such known manners of temporarily securing two adjacent elements (generally a "temporary closure 34").

In an embodiment, the upper 12 may include a plurality of air-permeable perforations 40 that extend through one of the first side portion 20 or the second side portion 22. The perforations 40 may include any form of holes, apertures, or breathable knit or woven fabric that permits airflow and/or ventilation through the respective side portion and into the interior cavity 16. In one embodiment, the perforations 40 may be provided only on the instep 32 (i.e., not on the flap 30), however, in another embodiment the perforations 40 may be provided both on the flap 30 and the instep 32.

While one of the first side portion 20 or the second side portion 22 may include a plurality of air-permeable perforations 40, the other side portion (such as shown at 42 in FIG. 4) may be substantially solid and/or water resistant. In this manner, folding the flap section 30 laterally in a first direction 44 (such as shown via the arrow in FIG. 2) covers the plurality of perforations 40 and provides the upper with a degree of water resistance; while folding the flap section 30 laterally in a second direction 46 exposes the plurality of perforations 40 to provide ventilation to the interior volume 16. Such a design may prove particularly attractive to people who expect to wear their shoes through various weather conditions and require temporary water resistance.

Figure 4:
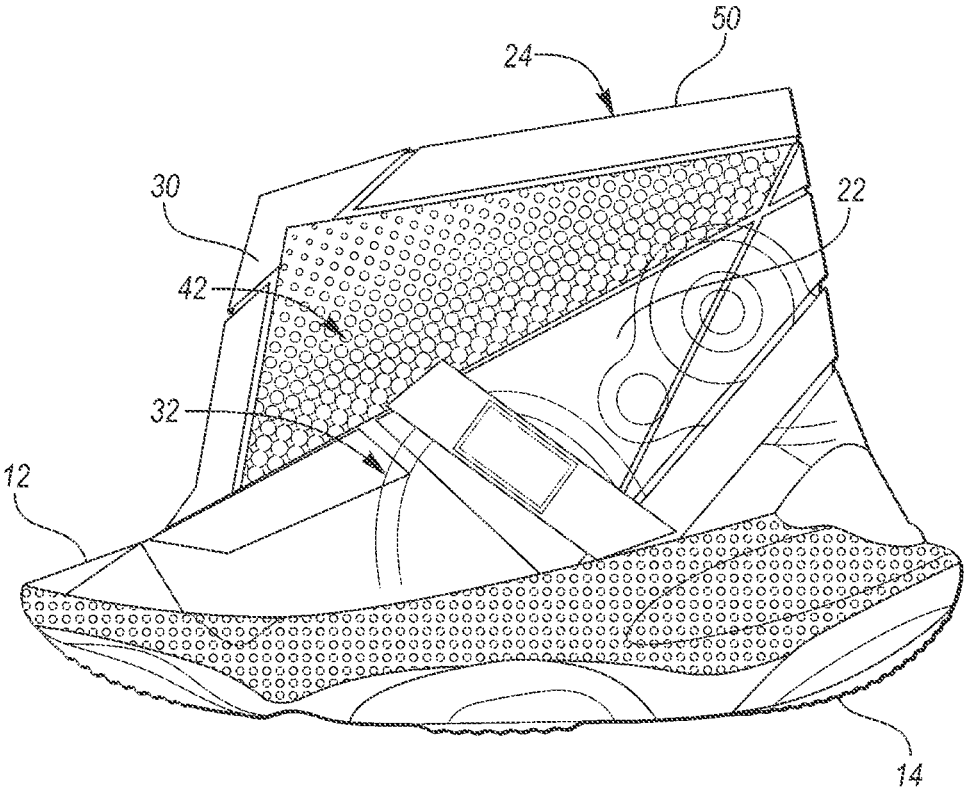
FIG. 4 is a schematic side view of a second side of an article of footwear with a forward flap section open to provide improved foot access.

In one configuration, the non-perforated side portion 42 of the flap section 30, along with the adjacent portion of the instep 32 and/or quarter (e.g., the first side portion 20 as shown in FIGS. 1-2 and 4), may be formed from a water resistant and/or water proof material. In some embodiments, these portions may be coated with a polymeric film that seals any openings. Alternatively, these portions may be formed from solid, non-perforated components. Finally, in some embodiments, these portions may be coated with a hydrophobic or super hydrophobic material that may cause any environmental water to roll off rather than soak in.

Figure 3:
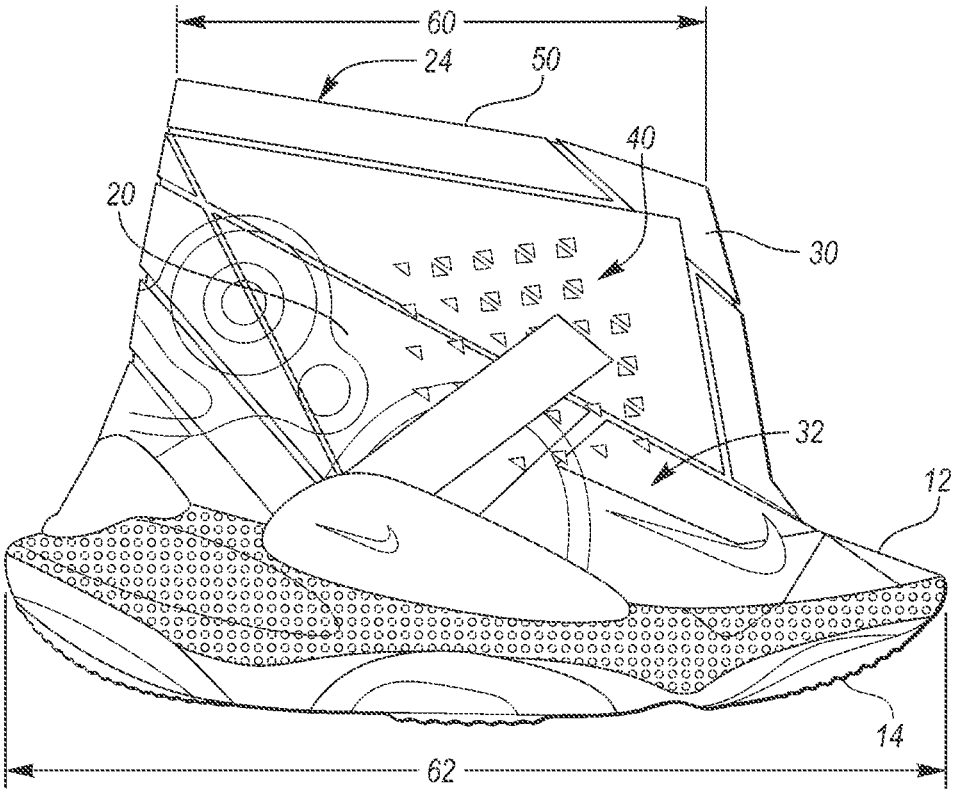
FIG. 3 is a schematic side view of a first side of an article of footwear with a forward flap section open to provide improved foot access.

With reference to FIGS. 3-4, the design of the present upper 12 may additionally provide increased access and/or accessibility to the interior volume 16. More specifically, when the flap section 30 is in a neutral position (i.e., folded in neither the first direction 44 nor the second direction 46), the flap section 30 may aid in forming an enlarged throat opening 50 through which the wearer's foot may more easily pass when putting on or taking off the shoe 10. When the flap section 30 is folded across the instep 32, the enlarged throat opening 50 may be reduced in size to a smaller throat opening 52 (such as shown in FIGS. 1-2) that may be more commensurate with the size of the wearer's ankle.

As shown in FIG. 3, the enlarged throat opening 50 may have a maximal longitudinal dimension 60 (i.e. a "length") that is measured between the furthest forward point of the opening 50 and the furthest rearward point of the opening 50. In much the same way, the sole 14 and/or upper 12 may have a maximal longitudinal dimension 62 that may similarly be measured between the furthest forward point of the sole 14 and the furthest rearward point of the sole 14. In one configuration, the length 60 of the enlarged throat opening 50 may be greater than about 50% of the length 62 of the sole 14. In other configurations, the length 60 of the enlarged throat opening 50 may be greater than about 60%, or greater than about 70%, or even greater than about 80% of the length 62 of the sole 14. Conversely, the length 60 of the enlarged throat opening 50 may be more than about 150% of the length 64 of the smaller throat opening 52, such as shown in FIG. 1. In other embodiments, the length 60 of the enlarged throat opening 50 may be more than about 175%, or more than about 200% of the length 64 of the smaller throat opening 52.

In another embodiment, the upper 12 may include a first plurality of air-permeable perforations that extend through a first side portion 20 and a second plurality of perforations that extend through a second side portion 22 of the upper 12. As with above, the perforations 40 may include any form of holes, apertures, or breathable knit or woven fabric that permits airflow and/or ventilation to the interior cavity 16 through the respective side portion. In one embodiment, however, the first plurality of perforations may be larger and/or more permeable than those provided on the second side portion. Additionally, in some embodiments, the second plurality of perforations may be treated with a hydrophobic coating to improve the ability for water to run off the surface without soaking into the upper 12.

Benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

The invention claimed is:

1. An article of footwear comprising:

a sole structure;

an upper coupled to the sole structure and at least partially defining an internal volume operative to receive a foot of a wearer, the upper including:

an throat opening that is in communication with the internal volume;

a forwardly extending flap section that defines a portion of the throat opening, wherein the flap section is operative to fold laterally across an instep portion of the upper to reduce a size of the throat opening from a first, enlarged state to a second, narrowed state;

a plurality of perforations extending through a portion of the upper on a first side of the flap section; and wherein folding the flap section laterally in a first direction covers the plurality of perforations; and wherein folding the flap section laterally in a second direction exposes the plurality of perforations to provide ventilation to the interior volume.

2. The article of footwear of claim 1, wherein the upper is water resistant on a second side of the flap section.

3. The article of footwear of claim 1, wherein the flap section comprises a first sidewall and a second sidewall that each define a portion of the throat opening; and wherein the first sidewall is integral with a first quarter of the upper, and the second sidewall is integral with a second quarter of the upper.

4. The article of footwear of claim 3, wherein the plurality of perforations includes perforations extending through the first sidewall of the flap section.

5. The article of footwear of claim 3, wherein the plurality of perforations includes perforations extending through the first quarter of the upper.

6. The article of footwear of claim 1, wherein the portion of the upper on the first side of the flap section comprises a knit or woven fabric, and wherein the plurality of perforations are formed via openings in the knit or woven fabric.

7. The article of footwear of claim 1, further comprising a temporary closure operative to secure the flap section in a first configuration folded laterally in the first direction or in a second configuration folded laterally in the second direction.

8. The article of footwear of claim 7, wherein the temporary closure includes a clasp, a strap, a hook and loop fastener, a snap, an elastic band, or a lace and hook.

9. The article of footwear of claim 1, wherein the throat opening has a first maximal longitudinal dimension and the sole structure has a second maximal longitudinal dimension that is measured parallel to the first maximal longitudinal dimension; and wherein the first longitudinal dimension is greater than 50% of a the second longitudinal dimension when the size of the throat opening is in the first, enlarged state.

10. The article of footwear of claim 1, wherein the size of the throat opening while in the first, enlarged state facilitates improved access of a foot into the interior volume.

11. The article of footwear of claim 1, wherein the sole structure includes a midsole and an outsole.

12. The article of footwear of claim 1, wherein the upper includes a second plurality of perforations on a second side of the flap section, wherein second plurality of perforations includes fewer perforations than the plurality of perforations on the first side of the flap.

13. The article of footwear of claim 1, wherein the first direction is substantially opposite from the second direction.

14. An upper for an article of footwear comprising:

a first side wall defining a first quarter of the upper and a second sidewall defining a second quarter of the upper, wherein the first sidewall and the second sidewall cooperate to at least partially define an internal volume operative to receive a foot of the wearer;

a throat opening that is in communication with the internal volume;

a forwardly extending flap section that defines a portion of the throat opening, wherein the flap section is operative to fold laterally across an instep portion of the upper to reduce a size of the throat opening from a first, enlarged state to a second, narrowed state;

wherein the flap section comprises a first sidewall and a second sidewall that each define a portion of the throat opening, the first sidewall being integral with the first quarter of the upper, and the second sidewall being integral with the second quarter of the upper;

a plurality of perforations extending through at least one of the first sidewall of the flap section or the first quarter;

wherein folding the flap section laterally in a first direction covers the plurality of perforations; and wherein folding the flap section laterally in a second direction exposes the plurality of perforations to provide ventilation to the interior volume.

15. The upper of claim 14, wherein the second sidewall and second quarter are water resistant.

16. The upper of claim 14, wherein the plurality of perforations includes perforations extending through both the first sidewall of the flap section and the first quarter.

17. The upper of claim 14, wherein at least one of the first sidewall of the flap section or first quarter comprises a knit or woven fabric, and wherein the plurality of perforations are formed via openings in the knit or woven fabric.

18. The upper of claim 14, further comprising a temporary closure operative to secure the flap section in a first configuration folded laterally in the first direction or in a second configuration folded laterally in the second direction.

19. The upper of claim 18, wherein the temporary closure includes a clasp, a strap, a hook and loop fastener, a snap, an elastic band, or a lace and hook.

20. The upper of claim 14, wherein the throat opening has a first maximal longitudinal dimension and the upper has a second maximal longitudinal dimension that is measured parallel to the first maximal longitudinal dimension; and wherein the first longitudinal dimension is greater than 50% of a the second longitudinal dimension when the size of the throat opening is in the first, enlarged state.

* * * * *